US005306128A

United States Patent [19]

Lee

[11] Patent Number: 5,306,128

[45] Date of Patent: Apr. 26, 1994

[54] DISCHARGE VALVE DEVICE OF A ROTARY COMPRESSOR

[75] Inventor: Seok J. Lee, Suwon, Rep. of Korea

[73] Assignee: Samsung Electronics Co., Ltd., Suwon, Rep. of Korea

[21] Appl. No.: 25,247

[22] Filed: Mar. 2, 1993

[30] Foreign Application Priority Data

Mar. 2, 1992 [KR] Rep. of Korea ..... 92-3438
Mar. 6, 1992 [KR] Rep. of Korea ..... 92-3740
Mar. 6, 1992 [KR] Rep. of Korea ..... 92-3741
Mar. 7, 1992 [KR] Rep. of Korea ..... 92-3782

[51] Int. Cl.[5] ..... F01C 21/00
[52] U.S. Cl. ..... 418/270; 418/63; 137/527.8; 137/540
[58] Field of Search ..... 137/527.8, 540; 918/240, 63

[56] References Cited

U.S. PATENT DOCUMENTS 4,149,834 4/1979 Eiermann ..... 418/270
4,781,551 11/1988 Tanaka ..... 418/270

FOREIGN PATENT DOCUMENTS 1-8706 3/1989 Japan .
1-15911 5/1989 Japan .
1-37190 11/1989 Japan .

*Primary Examiner*—Richard A. Bertsch
*Assistant Examiner*—Charles G. Freay
*Attorney, Agent, or Firm*—Burns, Doane, Swecker & Mathis

[57] ABSTRACT

A discharge valve device of a rotary compressor comprises a discharge passage formed in the wall of a cylinder for connecting to a compression chamber, a discharge valve for blocking/opening the discharge passage depending upon the gas pressure in the chamber, and a spring for restricting the movement of the discharge valve. The discharge valve moves along a passage wall in contact therewith during travel between its blocking/opening positions.

21 Claims, 7 Drawing Sheets

DISCHARGE VALVE DEVICE OF A ROTARY COMPRESSOR

BACKGROUND OF THE INVENTION

The present invention is related to a discharge valve device of a rotary compressor.

A rotary compressor is installed as one component in an air conditioner cooling cycle for compressing refrigerant to create a high temperature and high pressure. A conventional rotary compressor is comprised of a housing 1, a shaft 5 which is connected to a motor 2 provided in the housing 1, a roller 7 eccentrically mounted at the lower end of the shaft 5, and a cylinder 6 enclosing the roller 7 as shown in FIG. 1. An eccentric 51 (FIG. 2) is attached to the shaft 5 and is freely movably disposed in the roller 7. As the shaft 5 is rotated by the motor 2, the roller 7 rotates in an eccentric manner to compress the refrigerant taken in through a suction pipe 3. The pressed gas is discharged from the cylinder 6 and discharges through a pipe 4 provided at the top of the housing 1.

A conventional discharge process as used in the above described rotary compressor will now be described in detail. A conventional compressing device is illustrated in FIG. 2A and FIG. 2B. Roller 7 s provided at the lower end portion of the shaft 5. A vane 8 is located in the cylinder 6 and held in continuous contact with the roller 7 by a spring 9. A suction area 6S and a discharge or compressing area 6D are generated each defined within the cylinder 6 by the vane 8, the roller 7, and an inner wall of the cylinder 6. Considering the view in FIG. 2A, the suction pipe 3 is provided on the left side of the vane 8, while the discharge port 10 is located on the right side at the top or the bottom surface of the cylinder 6. An upper and lower support plate 13, 14 are mounted on the top surface and the bottom surface of the cylinder, respectively. The upper and lower support plate 13, 14 respectively, each contain discharge passage 15. As the shaft 5 is rotated, the roller 7 rotates in an eccentric manner. The refrigerant taken in through a suction pipe 3 is compressed, and the pressed gas is discharged through the discharge port 10 and the discharge passage 15. At the exterior portions of the discharge passage 15 plate valves 11 are provided. The discharge passage 15 is opened in the discharging mode by the pressure of the refrigerant. During the suction mode and compression mode of the refrigerant, the plate valves 11 close the discharge passage 15 as a result of their own elastic character.

In the discharge mode of this type of compressor, there is a problem in that the striking contact of the returning plate valves 11 against the outer seat of the discharge passage 15 due to their elasticity and to the discharge pressure from the cylinder 6 causes vibration noises. This noise is one of the major noises produced by a compressor.

For reducing noise, Japanese Utility Model Publication Nos. 1-15911 (1989), 1-8706 (1989), and 1-37190 (1989) have been proposed. All of those valves are formed in a circular design. While each of those valves decreases in the compressor noise level and the stress on the valves, each is attended with an insufficient capacity to absorb the shocks from the high pressure discharge gas.

SUMMARY OF THE INVENTION

In view of the foregoing, it is an object of this invention to provide a discharge valve device which can reduce vibrations as well as noise generating during the operation of the discharge valve.

This invention is a discharge valve device of a rotary compressor comprising a compression chamber, a cylinder enclosing the chamber, a discharge passage formed in the wall of the cylinder for connecting to the compressing chamber, a solid discharge valve for relative movement along the passage between the first position blocking the discharge passage and the second position releasing from the first position according to the gas pressure created in the chamber, and an elastic means for restricting the movement of the discharge valve.

According to one embodiment, the solid discharge valve has a cylindrical form which is disposed vertically within the discharge passage to enable rotational movement.

In one embodiment, the wall of the cylindrical valve is supported by the elastic means which is disposed within a cavity connected to the discharge passage.

In one embodiment, the cylindrical valve has a groove formed along its circular wall, the cylindrical valve further having a nose at one end thereof, the nose is contact with the elastic member which is formed as a wire spring.

Preferably, the nose is pushed by one end of the wire spring when at the first position, and the nose pushes one end of the wire spring when at the second position.

According to another embodiment, the solid discharge valve has a cubic form which is disposed parallel within the discharge passage, the lower surface of the cubic valve being supported by the elastic means.

According to another embodiment, the solid discharge valve has a cylindrical form having a collar at the lower end of the cylinder, the valve is disposed parallel within the passage, the lower surface of the collar is supported by the elastic means.

DETAILED DESCRIPTION OF THE PREFERRED EMBODIMENT

Figure 1:
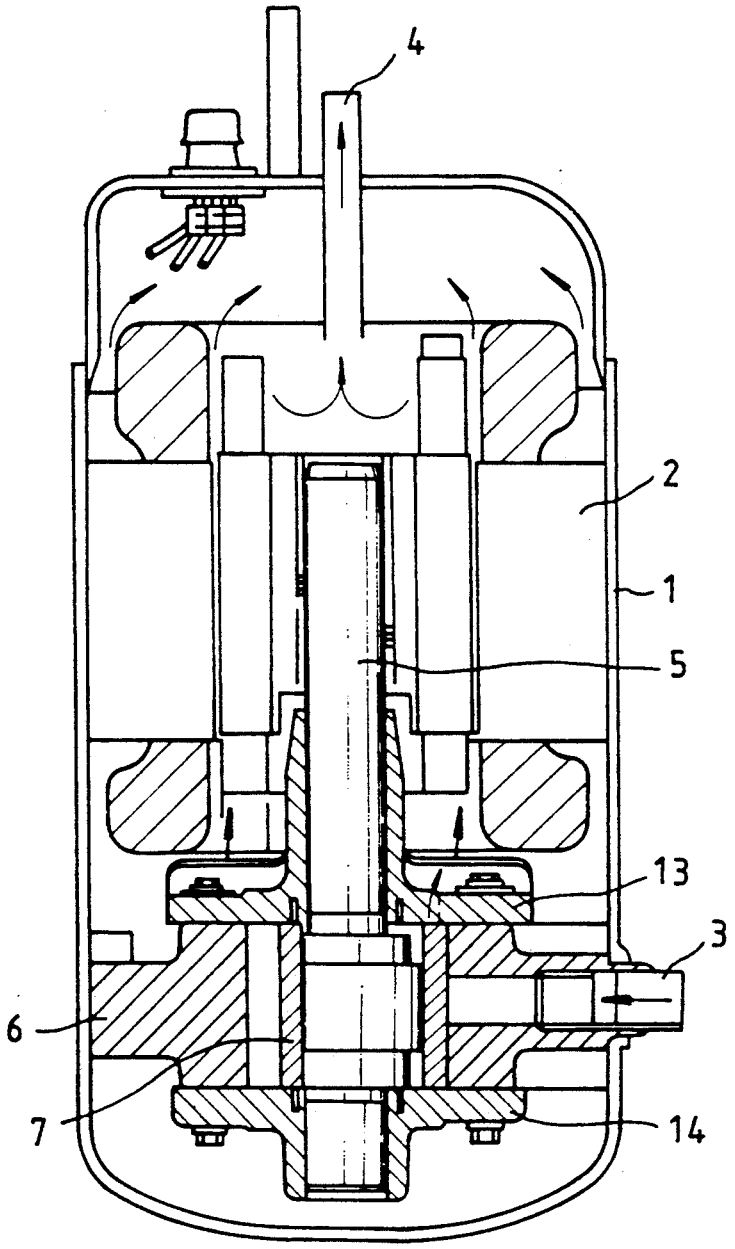
FIG. 1 (Prior Art)
FIG. 1 is a longitudinal sectional view of a rotary compressor according to the prior art.
Figure 2A:
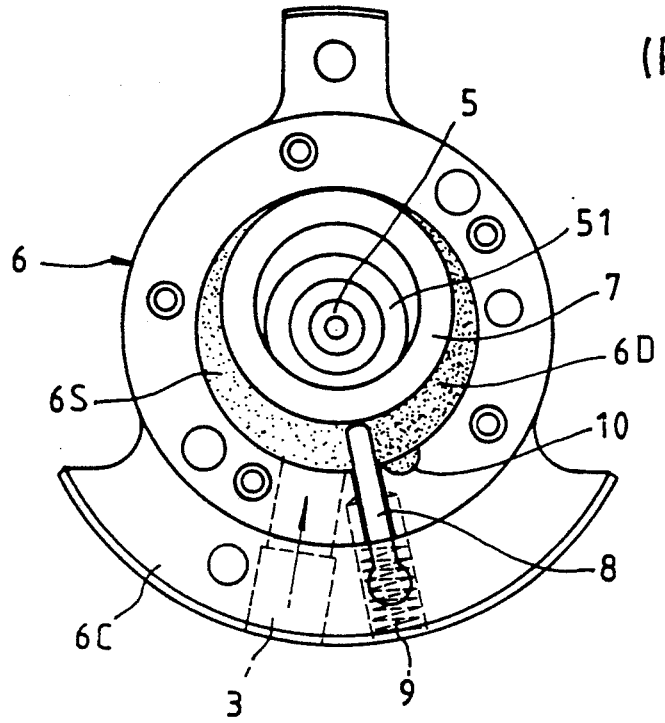
FIG. 2A (Prior Art)
FIG. 2A is a cross-sectional view of a compression member of FIG. 1.
Figure 2B:
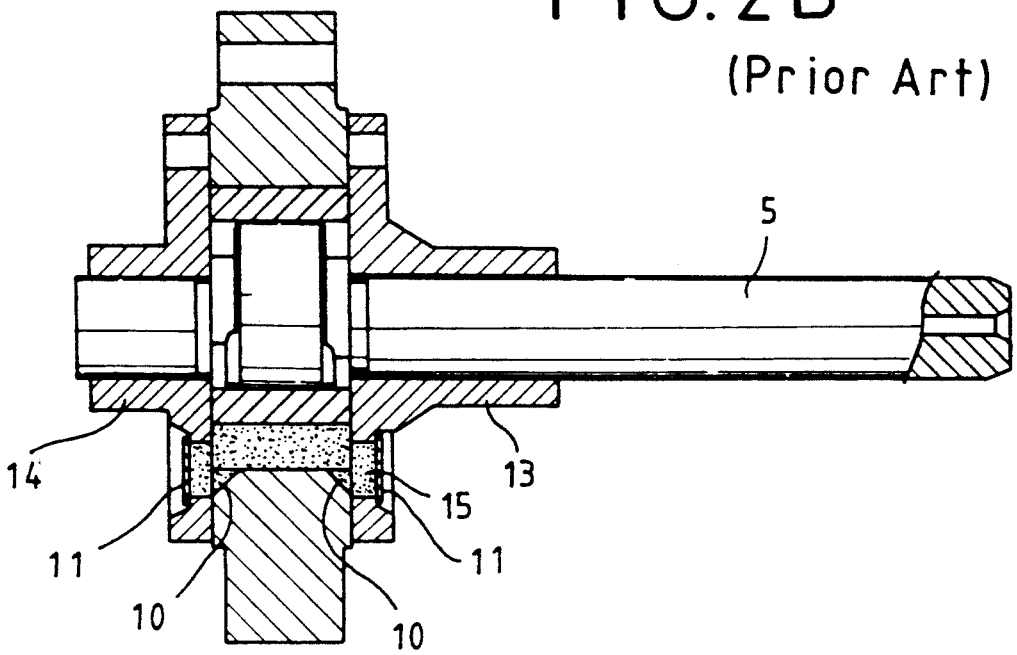
FIG. 2B (Prior Art)
FIG. 2B is a cross-sectional view of a compression member along a longitudinal direction of a rotating shaft of FIG. 2A.
Figure 3A:
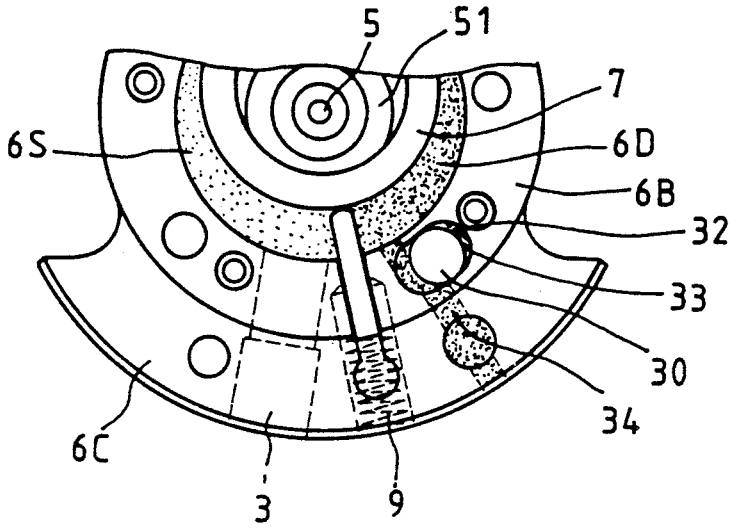
FIG. 3A is a cross-sectional fragmentary view of the compression member adapting a discharge valve device in the first preferred embodiment.
Figure 4A:
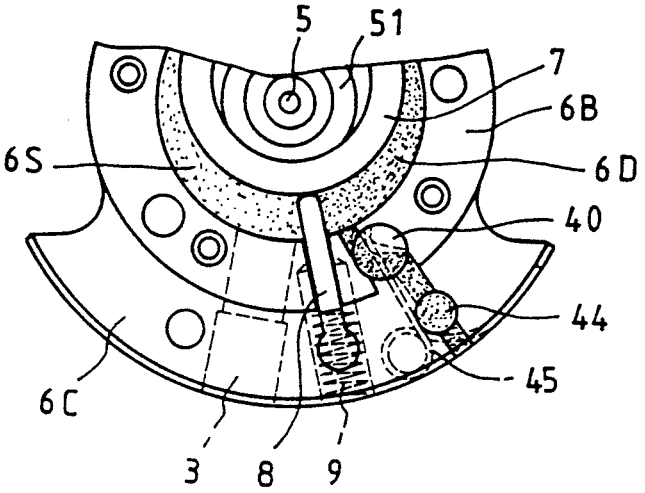
FIG. 4A is a cross-sectional fragmentary view of the compression member adapting a discharge valve device in the second preferred embodiment.
Figure 5A:
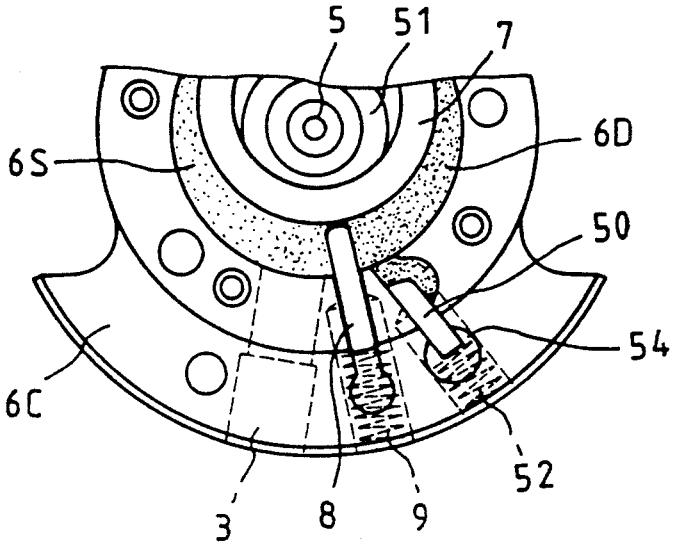
FIG. 5A is a cross-sectional fragmentary view of the compression member adapting a discharge valve device in the third preferred embodiment.

FIG. 3A, FIG. 4A and FIG. 5A are views illustrating three preferred compression members having a discharge valve device according to the present invention.

In each embodiment, the compression member comprises a cylinder 6, a suction pipe 3 for sucking refrigerant into the cylinder 6, a rotating shaft 5 extending through the cylinder 6, and a roller 7 through which the shaft 5 extends in an eccentric manner. An eccentric 51 is fixed to the shaft 5 and is freely disposed in the roller 7. On the wall of the cylinder 6 a vane 8 is provided, in which a spring 9 pushes continuously on the rear end of the vane 8. Further, the compression member comprises a discharge valve device of the present invention.

Figure 3B:
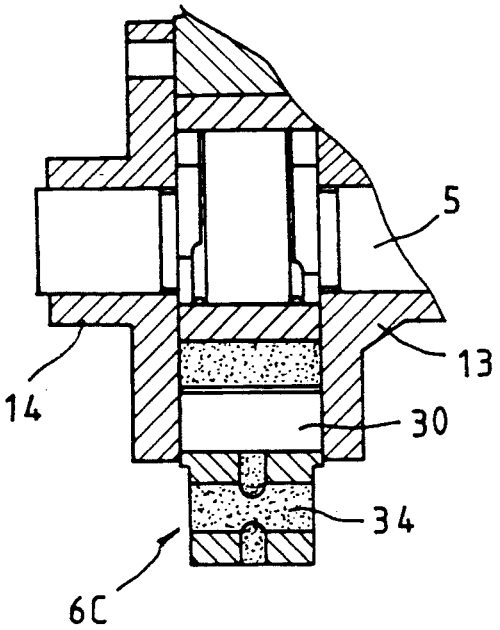
FIG. 3B is a fragmentary sectional elevation of FIG. 3A.
Figure 3C:
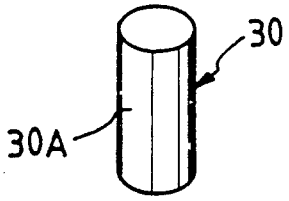
FIG. 3C is a perspective view of a discharge valve utilized in FIG. 3A.

In the embodiment according to FIGS. 3A–3C, the discharge valve device comprises a discharge passage 34 provided in the wall of the cylinder 6, a discharge valve 30 in a cylindrical shape, disposed within the discharge passage 34 for blocking and opening the passage 34, and a spring 32 for elastically supporting the valve 30. A suction area 6S and a discharge or compression area 6D are each defined within the cylinder 6 by the vane 8, the roller 7, and the inner wall of the cylinder 6. One end of the discharge passage 34 is connected to the compression area 6D through a body 6B of the cylinder and a side portion 6C of the cylinder. The another ends of the discharge passage 34 are provided at the top and bottom surface of the side portion 6C, respectively. A cavity 33 is provided at the middle of the body 6B of the cylinder for receiving the valve 30, in which the spring 32 is disposed. The spring 32 is designed to apply a return force to push the valve 30 toward the opposite portion of the cavity 33 so that the passage 34 is normally blocked by the valve 30.

The refrigerant compressed by the roller 7 pushes evenly along one line of the longitudinal side portion 30A of the valve 30, which side 30A defines a reaction surface. The valve 30 is then moved in a counterclockwise direction against the spring 32. Concurrently, the valve rotates (rolls) in a counterclockwise direction around its own longitudinal axis. Thus, the valve 30 travels along a passage surface in contact therewith. The discharge pressure is evenly applied across the entire surface of the side portion 30A. Because the valve 30 is out of the passage 34, the compressing refrigerant is discharged through the exterior end of the passage 34.

As set forth hereinabove, the first embodiment of the present invention is a discharge valve device. It operates consistently, i.e., without any fluctuations, with the solid valve according to the discharge operation. This provides for the quiet operation of the compressor. In particular, due to the rotation of the valve, excessive wear of this particular portion of the valve can be prevented.

FIGS. 4A, 4B, 4C and 4D are views illustrating the second preferred embodiment. No detailed description will be made of the components which are common to the first two embodiments.

A discharge valve 40 is shaped in a cylindrical solid form similar to that in the first embodiment and is disposed in a bore hole 49 so as to prevent movement along the inner wall of the cylinder but permit it to rotate in position. Around the circular wall of the valve 40 a groove 41 is provided as a reserve discharge passage (see FIG. 4D).

The discharge valve 40 also has a nose 42 at the bottom surface of the valve. A projecting portion 42P of the nose 42 and a slight flat portion 42S which is loosely connected to the projection of the nose are continuously in contact with one extending end 46 of a wire spring 45. The wire spring 45 is placed in contact with the bottom surface of the cylinder 6. The other extending end 47 of the wire spring 45 presses against the inner wall of the housing 1 along the circular side of the cylinder 6. Therefore, under normal circumstances the passage 41 of the valve 40 blocks the discharge passage 44.

Figure 4B:
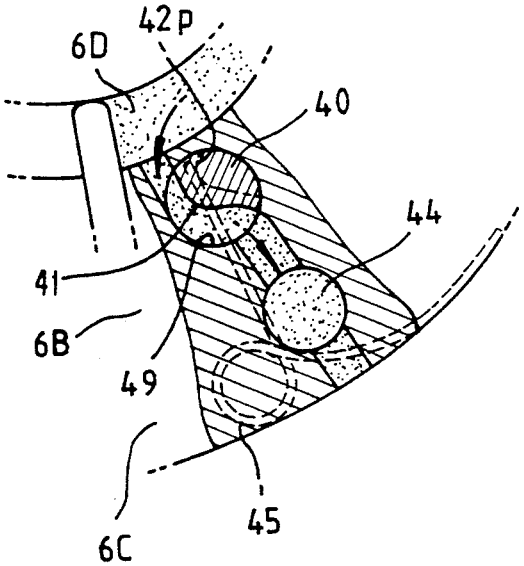
FIG. 4B is an enlarged fragmentary cross-sectional view of FIG. 4A with a discharge valve opened.
Figure 4C:
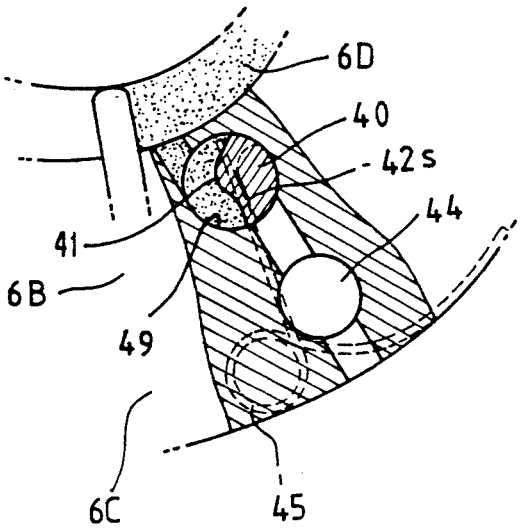
FIG. 4C is an enlarged fragmentary cross-sectional view of FIG. 4A with a discharge valve closed.
Figure 4D:
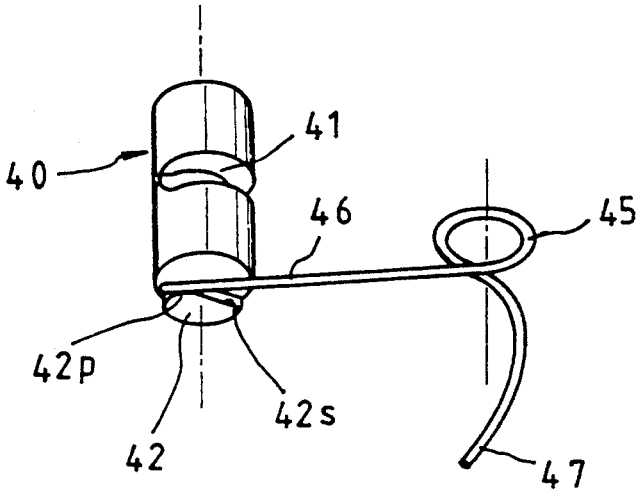
FIG. 4D is a perspective view of a discharge valve assembled with a wire spring utilized in FIG. 4A.

In other words, since the wire spring 45 constantly applies an elastic force to the nose 42, the valve 40 is in the position as shown in FIG. 4C, in which the discharge passage 44 is blocked. In the state of FIG. 4C, the refrigerant is compressed by the rotation of the roller 7 and the compressed refrigerant flows into the receiving end (i.e., a reaction surface) of the groove 41 thereby gradually opening a portion of the cross-section of the groove 41. When the pressure reaches the maximum amount, the entire cross-section of the groove 41 is opened as shown in FIG. 4B. The valve rotates in a counterclockwise direction in contact with a cylindrical passage surface, and the projecting portion 42P of the nose 42 pushes the end 46 of the wire spring 45. When the valve 40 is no longer held open by compressed fluid, the spring 45 moves the valve to its passage-closing position. That movement terminates when the return force applied by the spring dissipates. Hence, there is no need to employ a stop surface to terminate valve movement, as is evident from FIG. 4C, whereby the noise resulting from an impact of the valve against such a stop surface is avoided.

Figure 5B:
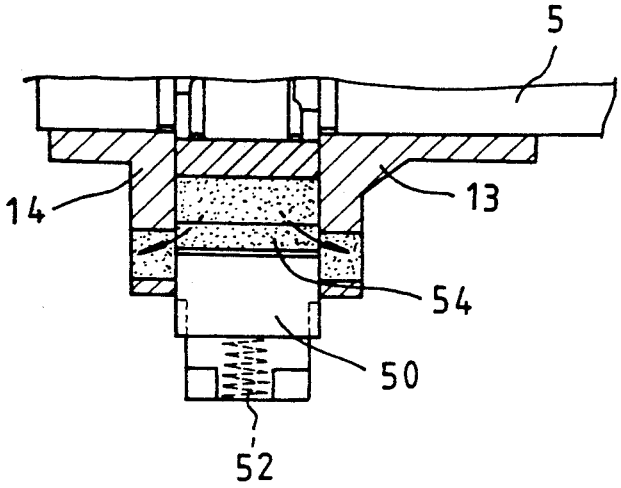
FIG. 5B is a fragmentary sectional elevation of FIG. 5A.
Figure 5C:
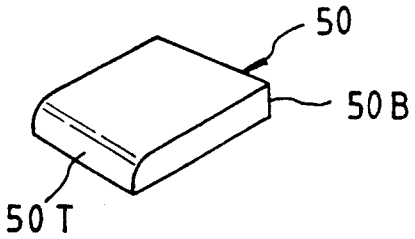
FIG. 5C is a perspective view of a discharge valve utilized in FIG. 5A.

FIGS. 5A, 5B and 5C are views illustrating a third preferred embodiment.

A discharge valve 50 is shaped as a block of solid rectangular form and is disposed parallel within the discharge passage 54. A spring 52 is disposed within the discharge passage 54 and one end surface of the spring 52 is in contact with the bottom 50B of the valve 50. Another end surface 50B of the spring 52 is in contact with the inner wall of the housing 1 and extends through the side portion 6C of the cylinder 6.

As the pressure in the compression area 6D increases, the compressed refrigerant gradually pushes the front top surface (i.e., a reaction surface) 50T of the valve 50 so that the valve moves backward along the discharge passage 54 in contact therewith. When the pressure of the discharge refrigerant reaches the maximum valve, the discharge opening of the passage 54 is completely opened. One edge of the front top surface 50T can be made round (FIG. 5C) so that the valve 50 more effectively responds to variations in the pressure.

Figure 6:
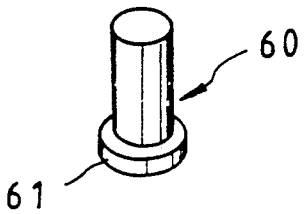
FIG. 6 is a perspective view of a discharge valve utilized in the fourth preferred embodiment.
Figure 3D:
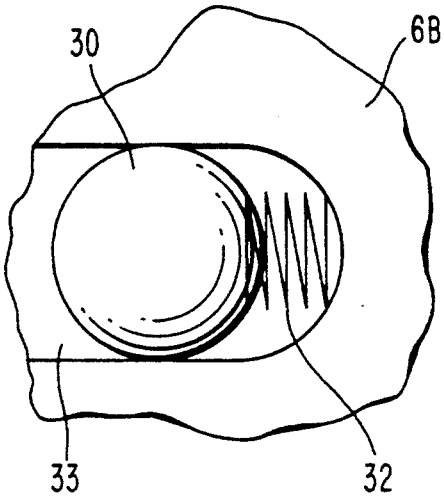
FIG. 3D is an enlarged fragmentary view of FIG. 3A.
Figure 6A:
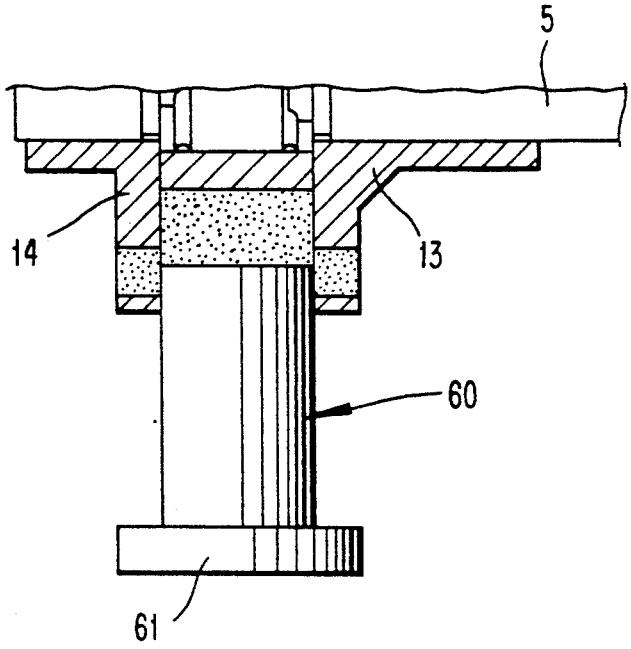
FIG. 6A is a view similar to FIG. 5B, but depicting the use of the discharge valve depicted in FIG. 6.

FIG. 6 is a view illustrating a fourth preferred embodiment. The solid discharge valve 60 is made in a cylindrical form. The valve further has a collar 61 at the lower end for supporting a spring 52. Except for the configuration of the valve 60, the other components of the above third embodiment can be employed in this fourth embodiment. To more effectively responses to the variations of the released pressure in the compression area, the top of the cylindrical valve can be made into the shape of a nose cone.

Because the valve of the present invention is made in a solid configuration, it can operate reliably according to the various discharge operations without a potential of the risk of fluctuations which results in the reduction of vibrations as well as noises during the operation of the discharge valve.

What is claimed is:

1. A rotary compressor comprising:

a body enclosing a compression chamber to which fluid is supplied;

means in said chamber for compressing the fluid; a discharge passage formed in said body in communication with said chamber for discharging the compressed fluid; and a discharge valve for repeatedly opening and closing said discharge passage, said discharge valve being biased to a passage-closing position blocking said discharge passage, and including a reaction surface arranged to be acted upon by compressed fluid for moving said discharge valve to a passage opening position, said discharge valve being arranged to move along at least a portion of a passage surface in contact therewith as said discharge valve moves between said passage opening and passage closing position, wherein said discharge valve travels in a direction generally transversely relative to a direction of fluid travel through said passage when moving between said passage-opening and passage-closing positions.

2. A rotary compressor according to claim 1, wherein said discharge valve is of generally circular cylindrical configuration.

3. A rotary compressor according to claim 2, wherein a longitudinal axis of said cylinder is oriented generally transversely to said direction of fluid travel.

4. A rotary compressor according to claim 3, including spring means arranged for storing energy during movement of said discharge valve from said passage-closing position to said passage-opening position under the urging of compressed fluid, and applying a return force to said discharge valve to return said discharge valve to said passage-closing position.

5. A rotary compressor according to claim 4, wherein said spring means comprises a compressible elastic body which is compressed by said discharge valve when said discharge valve moves toward said passage-opening position.

6. A rotary compressor according to claim 3, wherein said discharge valve is configured to roll along said passage surface when moving between said passage-opening and passage-closing positions.

7. A rotary compressor according to claim 3, wherein an outer cylindrical surface of said discharge valve defines said reaction surface.

8. A rotary compressor according to claim 3, wherein said discharge valve is configured to rotate about its longitudinal axis when moving between said passage-opening and passage-closing positions.

9. A rotary compressor according to claim 8, wherein said discharge valve includes a groove formed in an outer cylindrical surface of said discharge valve, said groove extending partially around said outer cylindrical surface in a generally circumferential direction, said groove conducting a flow of fluid when said discharge valve is in said passage-opening position.

10. A rotary compressor according to claim 9, wherein a surface of said groove defines said reaction surface.

11. A rotary compressor according to claim 10, including spring means arranged for storing energy during movement of said discharge valve from said passage-closing position to said passage-opening position under the urging of compressed fluid, and then applying a return force to said discharge valve to return the latter to said passage-closing position.

12. A rotary compressor according to claim 11, wherein an end of said discharge valve includes a projection having a non-circular outer surface, said spring means comprising a wire spring acting against said non-circular surface.

13. A rotary compressor according to claim 11, wherein movement of said discharge valve from said passage-opening position to said passage-closing position is terminated without said discharge valve striking a stop surface, so that said passage-closing position is defined independently of stop means.

14. A rotary compressor according to claim 1 including spring means arranged for storing energy during movement of said discharge valve from said passage-closing position to said passage-opening position under the urging of compressed fluid, and applying a return force to said discharge valve to return said discharge valve to said passage-closing position, wherein movement of said discharge valve from said passage-opening position to said passage-closing position is terminated without said discharge valve striking a stop surface, so that said passage-closing position is defined independently of stop means.

15. A rotary compressor comprising:

a body enclosing a compression chamber to which fluid is supplied;

means in said chamber for compressing the fluid;

a discharge passage formed in said body in communication with said chamber for discharging the compressed fluid;

a discharge valve for repeatedly opening and closing said discharge passage, said discharge valve including a reaction surface arranged to be acted upon by compressed fluid for moving said discharge valve from a passage-closing position to a passage-opening position; and spring means arranged for storing energy during movement of said discharge valve from said passage-closing position and applying a return force to said discharge valve to return said discharge valve to said passage-closing position, movement of said discharge valve to said passage-closing position being terminated without said discharge valve striking a stop surface, so that said passage-closing position is defined independently of stop means.

16. A rotary compressor comprising:

a body enclosing a compression chamber to which fluid is supplied;

means in said chamber for compressing the fluid; a discharge passage formed in said body in communication with said chamber for discharging the compressed fluid; and a discharge valve for repeatedly opening and closing said discharge passage, said discharge valve being biased to a passage-closing position blocking said discharge passage, and including a reaction surface arranged to be acted upon by compressed fluid for moving said discharge valve to a passage opening position, said discharge valve being arranged to move along at least a portion of a passage surface in contact therewith as said discharge valve moves between said passage opening and passage closing positions, wherein said discharge valve travels inside said discharge passage in a direction parallel to a direction of fluid flow through said discharge passage when moving between said passage-opening and passage-closing position.

17. A rotary compressor comprising:

a body enclosing a compression chamber to which fluid is supplied;

means in said chamber for compressing the fluid; a discharge passage formed in said body in communication with said chamber for discharging the compressed fluid;

a discharge valve for repeatedly opening and closing said discharge passage, said discharge valve being biased to a passage-closing position blocking said discharge passage, and including a reaction surface arranged to be acted upon by compressed fluid for moving said discharge valve to a passage opening position, said discharge valve being arranged to move along at least a portion of a passage surface in contact therewith as said discharge valve moves between said passage opening and passage closing positions; and spring means arranged for storing energy during movement of said discharge valve from said passage-closing position to said passage-opening position under the urging of compressed fluid, and applying a return force to said discharge valve to return said discharge valve to said passage-closing position, wherein movement of said discharge valve from said passage-opening position to said passage-closing position is terminated without said discharge valve striking a stop surface, so that said passage-closing position is defined independently of stop means.

18. A rotary compressor according to claim 17, wherein said discharge valve travels inside said discharge passage in a direction parallel to a direction of fluid flow through said discharge passage when moving between said passage-opening and passage-closing position.

19. A rotary compressor according to claim 18, wherein said discharge valve includes a front surface against which the compressed fluid acts, said front surface being inclined in a rearward direction.

20. A rotary compressor according to claim 18, wherein said discharge valve is configured as a generally rectangular block, a front surface of said block projecting into said discharge passage, said spring means arranged to act against a rear end of said block.

21. A rotary compressor according to claim 18, wherein said discharge valve is in the shape of a circular cylinder having a longitudinal axis arranged coaxially with said discharge passage.

* * * * *